US005960495A

United States Patent [19]

Hsu et al.

[11] Patent Number: 5,960,495

[45] Date of Patent: Oct. 5, 1999

[54] QUILT BEAM MATTRESS

[75] Inventors: Yaw-Yuan Hsu, Taipei; Chin-Hsiang Pan, Taipei Hsien, both of Taiwan; David R. Fisher, Rancho Palos Verdes, Calif.

[73] Assignee: Intex Recreation Corp., Long Beach, Calif.

[21] Appl. No.: 09/032,307

[22] Filed: Feb. 27, 1998

[51] Int. Cl.[6] ..... A47C 27/08; A47C 27/10

[52] U.S. Cl. ..... 5/706; 5/710

[58] Field of Search ..... 5/706, 710, 711; 156/87, 291

[56] References Cited

U.S. PATENT DOCUMENTS

| | | | |
|---|---|---|---|
| D. 266,470 | 10/1982 | Gammons et al. . | |
| D. 304,652 | 11/1989 | Viesturs . | |
| D. 314,804 | 2/1991 | Thomas . | |
| D. 314,809 | 2/1991 | Thomas . | |
| D. 315,187 | 3/1991 | Thomas . | |
| D. 315,189 | 3/1991 | Thomas . | |
| D. 315,388 | 3/1991 | Thomas . | |
| D. 315,389 | 3/1991 | Thomas . | |
| D. 315,774 | 3/1991 | Thomas . | |
| D. 341,983 | 12/1993 | Wang . | |
| D. 357,156 | 4/1995 | Wolfe . | |
| D. 365,378 | 12/1995 | Wolfe . | |
| D. 366,084 | 1/1996 | Wolfe . | |
| D. 378,719 | 4/1997 | Fireman . | |
| 585,834 | 7/1897 | Ruth . | |
| 3,672,950 | 6/1972 | Murphy et al. | 156/291 |
| 3,705,429 | 12/1972 | Nail . | |
| 3,790,975 | 2/1974 | Philipp et al. . | |
| 4,371,999 | 2/1983 | Reid . | |
| 4,547,919 | 10/1985 | Wang . | |
| 4,644,597 | 2/1987 | Walker . | |
| 4,823,417 | 4/1989 | Fukuichi . | |
| 5,031,260 | 7/1991 | La Bianco . | |
| 5,137,592 | 8/1992 | La Bianco . | |
| 5,243,723 | 9/1993 | Cotner et al. | 5/706 X |
| 5,437,068 | 8/1995 | Fisher . | |
| 5,490,295 | 2/1996 | Boyd . | |
| 5,604,945 | 2/1997 | Fisher et al. | 5/706 |

*Primary Examiner*—Terry Lee Melius
*Assistant Examiner*—James M. Hewitt
*Attorney, Agent, or Firm*—Malcolm B. Wittenberg

[57] ABSTRACT

An inflatable air mattress which includes a top sheet and bottom sheet of flexible air impermeable material. When inflated, the mattress is provided with a series of tube beams running the length of the air mattress. These beams are sealed to the top and bottom sheets of the air mattress by a sinusoidal sealing pattern.

9 Claims, 3 Drawing Sheets

QUILT BEAM MATTRESS

TECHNICAL FIELD OF THE INVENTION

The present invention deals with an inflatable air mattress with enhanced stability characteristics us compared to air mattresses of the prior art. The present air mattress is characterized as having a series of internal beams running longitudinally of the mattress, each beam being sealed to the top and bottom surfaces of the mattress by a series of sinusoidal seals enhancing the mattress stability characteristics.

BACKGROUND OF THE INVENTION

Air mattresses have enjoyed wide popularity for a number of reasons. When not in use, the air mattress is capable of being deflated to a substantially two-dimensional geometry which can be folded compactly and stored and transported quite easily. When inflated, air mattresses provide the user with a generally high level of comfort as the user is literally supported upon a cushion of air isolating the user from what would be an otherwise uncomfortable sleeping surface such as natural terrain encountered on a typical camping excursion.

Although air mattresses are relatively inexpensive and enjoy those advantages recited above, such products are not universally embraced by the consuming public and they rarely are seen as suitable replacements for more conventional bedding. One of the primary reasons for this lack of universal acceptance is that air mattresses, at least to date, have not provided the user with a generally level, comfortable and firm sleeping surface. Conventional air mattresses tend to exhibit a characteristic "give" where the user's body causes redistribution of air within the mattress resulting in areas of "bulge" surrounding the user's body.

Attempts have been made to address this perceived shortcoming in several different ways. For example, U.S. Pat. No. 3,705,429 discloses an inflatable mattress by locating a plurality of inflatable beams, columns or chambers within an outer inflatable chamber. Each beam is separately inflatable with its own inflation valve to provide inflated substructures within an overall air mattress geometry. Although conceptually the configuration shown in U.S. Pat. No. 3,705,429 is of interest, in practice, it provides only modest improvement over mattresses without such expedients and, noting that each beam is separately inflatable, the task of inflating the mattress and each individual beam can prove daunting for many users. In addition, each beam represents a separate area of potential leakage so that its use is not as practical as one might hope.

It is thus an object of the present invention to provide an air mattress which characteristically creates a generally level, comfortable and firm sleeping surface while not being overly complex to produce and maintain.

A further object of the present invention is to provide an air mattress which is characterized as exhibiting lateral load stability having a substantial "box-like" effect to provide the user with a sense of firmness and stability characteristic of traditional bedding.

These and further objects will be more readily appreciated when considering the following disclosure and appended claims.

BRIEF DESCRIPTION OF THE DRAWINGS

The invention will be more fully understood with reference to the accompanying drawings in which.

SUMMARY OF THE INVENTION

The present invention is directed to an inflatable air mattress comprising a top sheet and bottom sheet of flexible substantially air impermeable material. When inflated, the air mattress is characterized by having parallel opposing top and bottom edges and parallel opposing side edges substantially perpendicular to the top and bottom edges. In other words, the present configuration is intended to be rectangular in shape.

A valve is configured within either the top or bottom sheet making up the air mattress which allows for the selective passage of air to inflate and deflate it. A series of at least four tube beams, each having substantially parallel side walls connect the top and bottom surfaces of the air mattress and each tube beam runs longitudinally of the mattress such that the side walls of the beams are substantially parallel to the side edges of the air mattress. Importantly, each tube beam is sealed to the top and bottom sheets of the air mattress by a sinusoidal sealing pattern.

DETAILED DESCRIPTION OF THE INVENTION

Figure 1:
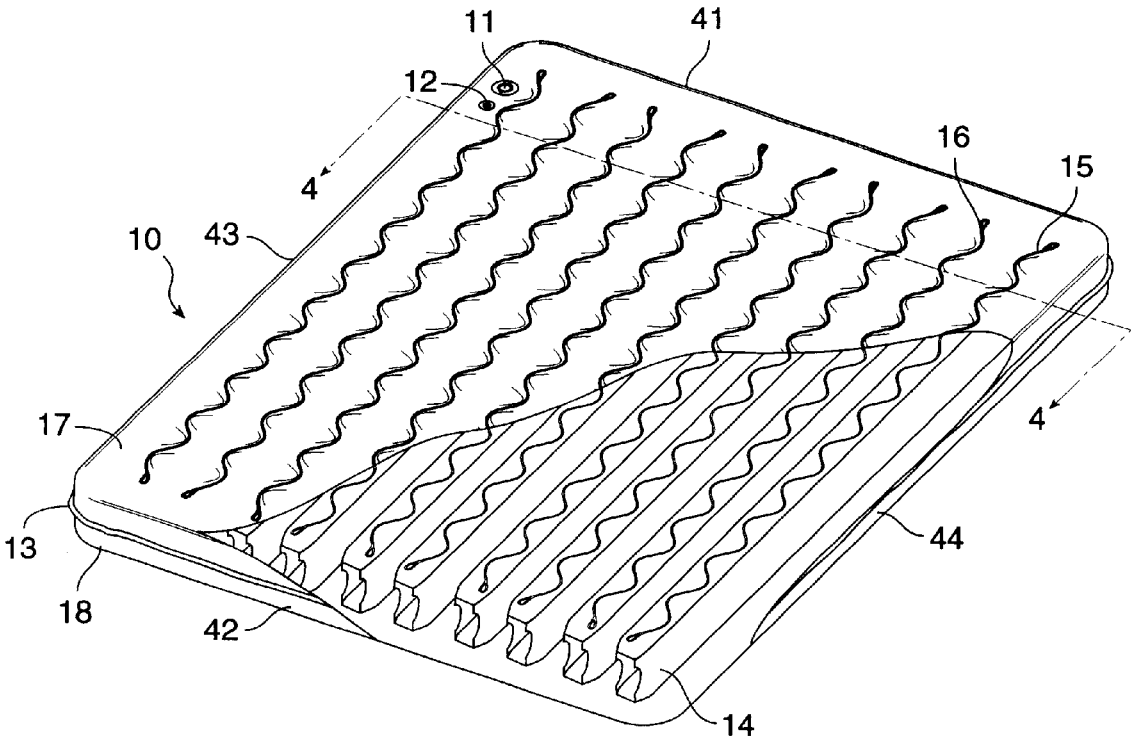
FIG. 1 is an isometric perspective view in partial cutaway illustrating the feature of the present invention.

For detailed description of the invention, reference is made to the various figures. FIG. 1 shows the overall structure of the present invention as air mattress 10 whereby top surface 17 is shown in partial cutaway to reveal the inner structure of the product. The top sheet 17 and the bottom sheet 18 are ideally produced from polyvinyl chloride resin and are connected throughout the periphery of mattress 10 at seal 13. Top sheet 17 and bottom sheet 18 can be sealed at 13 by any one of a known sealing pattern such as a lap seal, butt seal and I-beam seal. These various sealing expedients are well known in the manufacture of air mattresses, generally.

Air mattress 10, when inflated, is characterized as having parallel opposing top and bottom edges 41 and 42 respectively and parallel opposing side edges 43 and 44, respectively, the latter being substantially perpendicular to top and bottom edges 41 and 42. In other words, as its most preferred embodiment, the present invention is intended to assume the shape of a rectangle with side edges 43 and 44 being longer than top and bottom edges 41 and 42.

Valves 11 and 12 are configured within either the top or bottom sheets for allowing the selective passage of air to inflate and deflate the air mattress.

Figure 2:
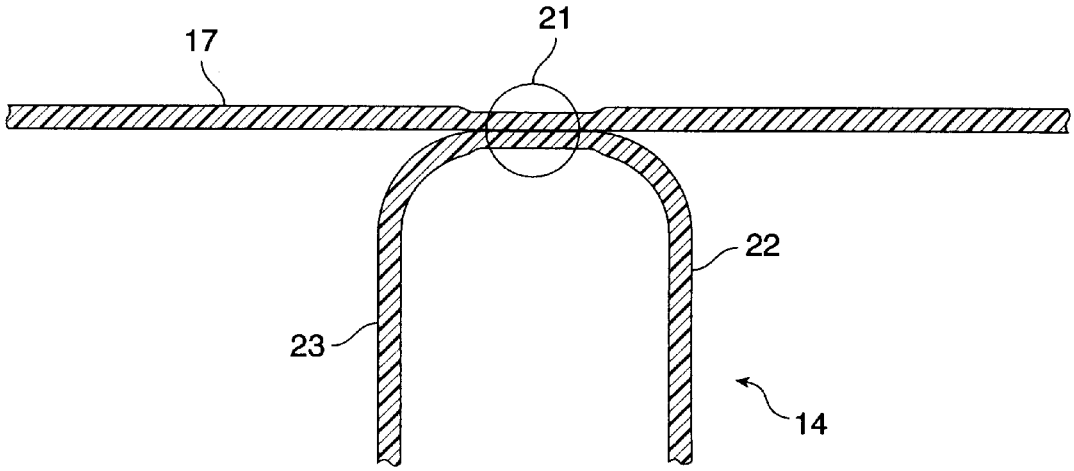
FIG. 2 is a cross-sectional partial view of the present invention showing the attachment of a beam to a top sheet of the mattress.

Mattress 10 is provided with a series of at least four tube beams 14, each having substantially parallel side walls 22 and 23 (FIG. 2) located between the top and bottom sheets. Tube beams 14, as shown in FIG. 1, each run substantially parallel to side edges 43 and 44. In other words, each beam is parallel to the longitudinal edges of mattress 10. In addition, tube beams 14 are spaced substantially equidistant from each other and are open proximate top and bottom edges 41 and 42 so that the tube beams stretch open with air as the mattress inflates with air through valve 11 and/or 12.

As noted previously, it is the intent of the present invention to provide an air mattress with a generally level and firm sleeping surface characteristic of a product with a box-like configuration. This is accomplished by providing sinusoidal sealing patterns which seal each tube beam 14 to top and bottom sheets 17 and 18 comprising the outer surface of air mattress 10.

Certain observations can be made regarding the sinusoidal sealing pattern 15 and 16 which enables this configuration to provide the characteristics desirable of any mattress-like support surface. At the outset, it is noted that sinusoidal sealing patterns 15 and 16 travel substantially the length of each longitudinally extending tube beam 14. In addition, sinusoidal sealing patterns 15 and 16 are out of phase with one another and, as a most preferred embodiment, the sinusoidal sealing pattern of each beam is 180° out of phase with the sinusoidal sealing pattern of an adjacent beam. Stated differently, each sign wave is provided with a peak and valley and sinusoidal sealing patterns of adjacent beams have their peaks and valleys in exactly the opposite locations so that the sealing patterns serpentine toward each and away from each other as they progress through the longitudinal length of air mattress 10. Applicant has determined that such a geometry provides the closest emulation of a "box-like" structure providing the firm support sought herein. Each sinusoidal sealing pattern is generally confined within area 21 shown in FIG. 2 as attaching beam 14 and its side walls 22 and 23 to top sheet 17.

Figure 4:
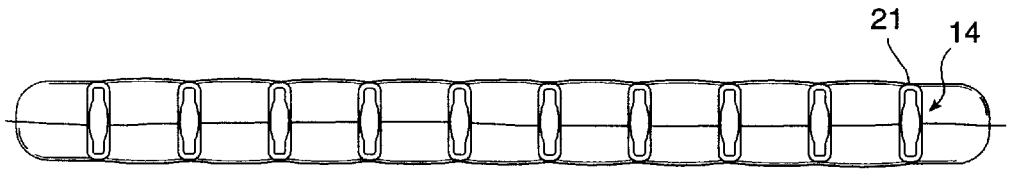
FIG. 4 is a cross-sectional view of the mattress of FIG. 1 taken along line 4—4 thereof.

This configuration shown anew in FIG. 4 for each tube beam 14 is shown as maintaining its "box-like" geometry as a result of sinusoidal patterns 15 and 16 (FIG. 1) confined to area 21.

Figure 3:
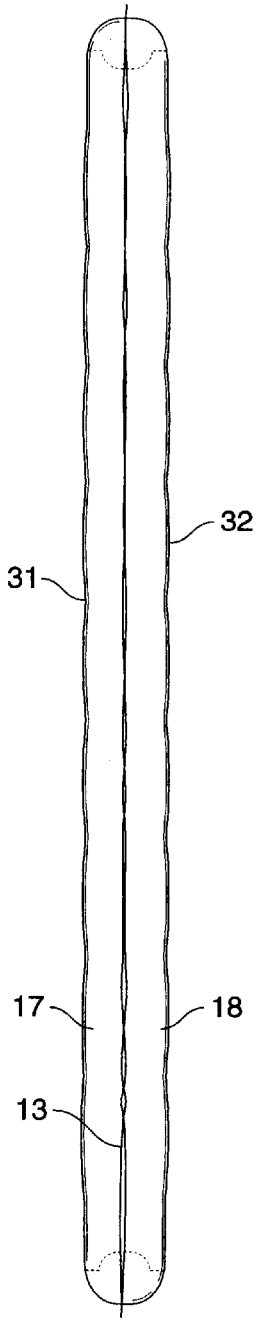
FIG. 3 is a side view of the mattress of the present invention.

FIG. 3, as noted above, depicts a side view of the present invention. It is noted that top and bottom sheet material sealed at 13 produces top and bottom surfaces 31 and 32, respectively, which take on a somewhat quilted geometry. It is characteristic of the present invention to further provide the user with a sense of rigidity and support lacking in air mattress products of the prior art.

Figure 5:
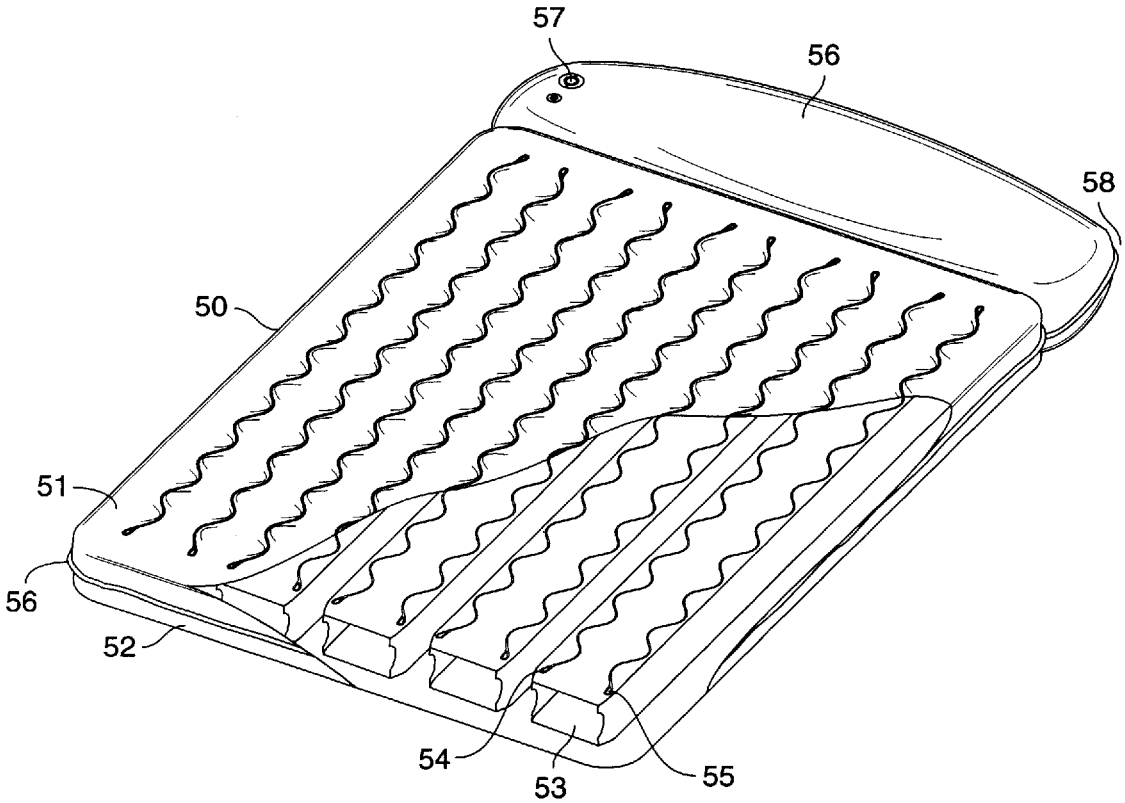
FIG. 5 is a isometric perspective view of a second embodiment of the mattress of the present invention in partial cutaway.

FIG. 5 depicts yet a further embodiment of the present invention. In this embodiment, mattress 50 is provided with top sheet 51 and bottom sheet 52 joined at seam 56. As was the case with the embodiment shown in FIG. 1, air mattress 50 includes a series of longitudinally arranged beams 53 each generally evenly spaced from one another within the entire internal volume of air mattress 50.

The configuration shown in FIG. 5 differs from that shown in FIG. 1 in that each beam 53 is appended to both top surface 51 and bottom surface 52 by a pair of sinusoidal seals 54 and 55. Again, ideally, the sinusoidal seals are out of phase with one another and, preferably, 180° out of phase so that as one progresses down the longitudinal surface of air mattress 50, sinusoidal seals 54 and 55 move closer to one another and then diverge from one another in a regular sinusoidal pattern.

The present invention, whether its the embodiment shown in FIG. 1 or that shown in FIG. 5 can include an inflatable pillow located proximate to top edge 58 of mattress 50. Inflatable pillow 56 can be provided with its own valve 57 for allowing the selective passage for air to inflate and deflate the pillow independently of the air mattress.

We claim:

1. An inflatable air mattress comprising a top sheet and bottom sheet of flexible, substantially air impermeable material, said air mattress when inflated having parallel opposing top and bottom edges and parallel opposing side edges substantially perpendicular to said top and bottom edges, a valve configured within either said top sheet or bottom sheet for allowing the selective passage of air to inflate and deflate said air mattress, a series of at least four tube beams each having substantially parallel side walls between said top and bottom sheets and each running substantially parallel to said side edges of said air mattress and wherein each of said tube beams being sealed to said top and bottom sheets by a sinusoidal sealing pattern which is out of phase with a respective sealing pattern formed on a next adjacently positioned tube beam, for providing a box contour of said tube beams when air is inserted into said air mattress.

2. The inflatable air mattress of claim 1 wherein the sinusoidal sealing pattern of each beam is 180° out of phase with the sinusoidal sealing pattern of an adjacent beam.

3. The inflatable air mattress of claim 1 wherein said tube beams are spaced substantially equidistant from each other.

4. The inflatable air mattress of claim 3 wherein the sinusoidal sealing patterns are spaced equidistant from each other.

5. The inflatable air mattress of claim 1 wherein said tube beams are open proximate said top and bottom edges of said air mattress so that said tube beams stretch open as the mattress inflates with air through said valve.

6. The inflatable air mattress of claim 1 wherein each of said tube beams is sealed to said top and bottom sheets by providing two sinusoidal sealing patterns at said top sheet and two sinusoidal sealing patterns at said bottom sheets.

7. The inflatable air mattress of claim 1 wherein said two sinusoidal sealing patterns at said top sheet are 180° out of phase with each other and said two sinusoidal sealing patterns at said bottom sheet are 180° out of phase with each other.

8. The inflatable air mattress of claim 1 further comprising an inflatable pillow located proximate to said top edge.

9. The inflatable air mattress of claim 8 wherein said pillow is provided with its own valve for allowing the selective passage of air to inflate and deflate said pillow independently of said air mattress.

* * * * *